United States Patent [19]

Tachibana

[11] Patent Number: 4,482,060

[45] Date of Patent: Nov. 13, 1984

[54] FISH-EGG SORTING APPARATUS

[76] Inventor: Masataka Tachibana, 6-9-305, Hanamigawa, Chiba-shi, Chiba, Japan

[21] Appl. No.: 379,744

[22] Filed: May 19, 1982

[51] Int. Cl.[3] ..... B07C 5/342

[52] U.S. Cl. ..... 209/588; 209/644; 119/3

[58] Field of Search ..... 119/3; 209/588, 644, 209/906

[56] References Cited

U.S. PATENT DOCUMENTS 4,009,782 3/1977 Grimshaw ..... 209/588

4,172,528 10/1979 Morishita et al. ..... 209/644

*Primary Examiner*—Hugh R. Chamblee

*Attorney, Agent, or Firm*—Jordan B. Bierman

[57] ABSTRACT

Apparatus for sorting living eggs from a mixture of live eggs and dead eggs during the process of artificial incubation of salmon, trout, and the like, in which fish eggs fed with water onto a rotary disc are moved radially outwardly to form a row of eggs along a guide plate at the outer periphery of the rotary disc by centrifugal force. A photocell sensor projects light on the row of eggs to detect reflected light to differentiate between the dead eggs and the live eggs, and high speed injection of air moves the dead eggs detected by the sensor to a different radial position on the rotary disc for separating them from the live eggs. Subsequently, the live eggs flow from the end of the guide plate through a good egg acceptance port into a good egg hopper and the dead eggs separated by high speed air flow through a bad egg acceptance port into a different hopper.

8 Claims, 7 Drawing Figures

37
28
25
26
43
27
44
29
24
39
40
15
19
B
18
17
14
21
32
16
D
C

FISH-EGG SORTING APPARATUS

BACKGROUND OF THE INVENTION

1. Field of the Invention

The present invention relates to an apparatus for sorting fish eggs, which apparatus is adapted to automatically sort and remove bad eggs produced during the process of incubation for fish eggs of salmons, trout and the like so as to take out only good eggs.

2. Description of the Prior Art

To cope with the volume catch of fishes with the recent modernization of fishery equipment, the exhaustion of fishes resources resulting therefrom, the restriction of offshore fishing of salmons with the recent establishment of the 200 sea miles fishery exclusive water basin, etc., every country is planning to change their policy of the fishery from the catch-only fishery to the fishery which introduces artificial enhancement or increase to gather fishes. This trend is remarkable particularly in the artificial enhancement enterprises of salmon resources. Therefore, the scale of the incubation and enhancement of salmon eggs tends to enlarge increasingly.

Also in Japan, the incubation of eggs carried out in the largest-scale salmon egg hatchery reaches 1.3 hundred million grains a season. With this, in the sorting operation of fish eggs, the number of eggs sorted in the season amounts to 4,000,000 to 5,000,000 eggs/day. It is therefore greatly desired that salmon-egg sorting apparatus is popularized and sorting apparatus itself is increased in capacity in order that the sorting capacity of salmon eggs may be enhanced.

To meet these demands as noted above, several salmon-egg sorting apparatuses have been heretofore used. For example, in one apparatus, a rotary disc is formed in the vicinity of an outer peripheral surface thereof with a number of holes to absorb fish eggs so that fish eggs are absorbed one at a time into each hole to sense and remove bad eggs. In another apparatus, a disc formed with a plurality of holes having a dimension capable of accommodating only one grain of fish egg is rotated in water in which fish eggs are floating (see Japanese Patent Publication No. 5,169/67). However, in the former, the construction thereof is complicated and the sorting capacity is about 120,000 grains/hour, and in the latter, it is necessary to change the dimension of the diameter of hole accommodating the fish egg in response to the change in size of fish egg, resulting in an extreme reduction in sorting capacity due to replacement of the fish-egg accommodating disc. In addition, the sorting capacity is merely about 100,000 grains/hour at the maximum.

These conventional apparatuses were necessary to provide with complicated mechanisms for aligning fish eggs regularly and in predetermined spaced relation to meet the capacity of the apparatus for discriminating and sorting living eggs from dead eggs. It has been however found that if the fish-egg sorting station responds quickly, sorting may be achieved without hindrance despite of the presence of unevenness in spacing to some extent or the continuous disposition as long as the fish eggs are aligned in one row. From this, the present invention has made possible to provide alignment of fish eggs in one row and quick sorting by the provision of an extremely simple device.

SUMMARY OF THE INVENTION

When fish eggs along with water are supplied to the area near the center of a rotary disc which rotates at the rate of 60 revolutions per minute, the fish eggs rotating together with the disc are subjected to a centrifugal force and are moved toward the peripheral edge of the disc. At this time, when a suitable quantity of water is supplied onto the disc, slipping of the eggs on the disc is aided, and if a guide plate is provided on the disc, the eggs may be supplied to a fixed position in the peripheral edge of the disc. Eggs from the supply station are developed into one row along a fixed guide plate disposed along the peripheral edge of the disc and rotate together with the disc. The light is projected on the row of eggs to detect a difference in reflection factor of light between transparent living eggs and whitened dead eggs.

An injection port for high speed air is provided adjacent to the dead egg detector station, and dead eggs are selectively slightly blown and moved toward the center of the disc immediately before the end of the fixed guide in the peripheral edge of the disc by a stream of discharged air from a high speed responsive type solenoid system air valve actuated by the dead egg detection signal. The egg row flows down externally of the disc from the end of the fixed guide, but since bad eggs are blown and moved toward the center of the disc, the position to which they flow down externally of the disc is different from that of good eggs. When both kinds of eggs are received by separate hoppers, the living and dead eggs are respectively separated and taken out of the hoppers.

DETAILED DESCRIPTION OF THE PREFERRED EMBODIMENT

The present invention will now be described in detail in conjunction with the accompanying drawings.

Figure 4:
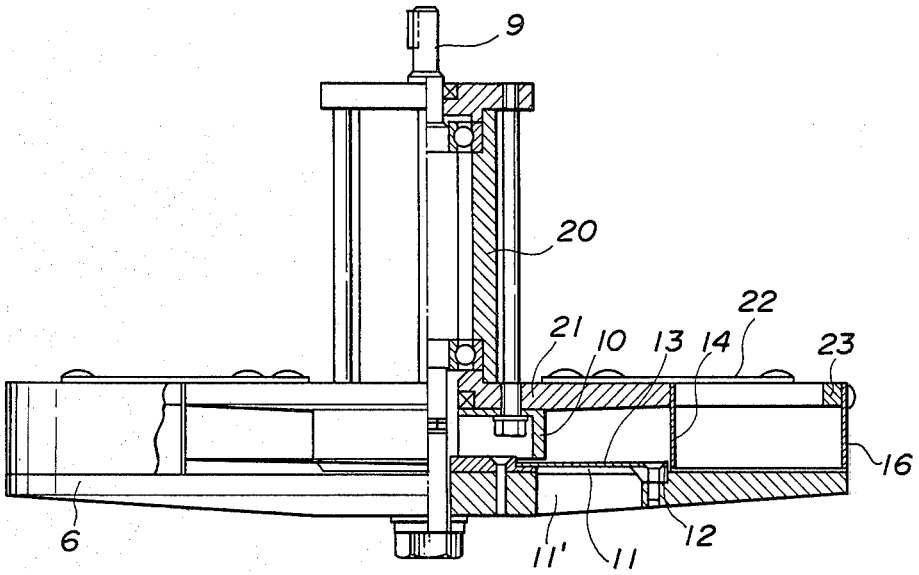
FIG. 4 is a sectional view taken on line B-O-C-D thereof.
Figure 5:
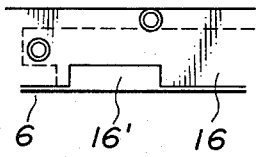
FIG. 5 is a fragmentary view of a falling portion of surplus eggs to a water tank.

In the embodiment shown in the drawings, a body 1 accommodates therein a water tank 2 and an air compressor 3 and has a sorting unit 4 placed on and secured to the top thereof. The sorting unit 4 is suspended while incorporating all of members necessary to sort bad eggs from an upper base plate 5, and has a rotary disc 6 for aligning fish eggs suspended in the lower portion thereof. Reference numeral 7 designates a motor for driving the disc 6, said motor being suspended from the base plate 5, and a shaft 9 of the disc 6 is driven by a chain 8 through a speed change gear. In the illustrated embodiment, as shown in FIG. 4, the upper surface of the disc 6 has a portion, which is fitted in a cap 10 to prevent entry of water into the central shaft portion, increased in height by one step, and the outside thereof is formed slightly higher than the surface which runs the peripheral edge portion of the disc 6, said raised portion being formed with a water groove 11. The water groove 11 has a suitable number of holes 11' through which water is discharged into the lower water tank 2. The upper surface of the water groove 11 is covered with a wire-netting 13.

The rotary disc 6 is divided into an internal side and an external side by a step 12 of the surface having the water groove and an inner guide plate 14 is hung along said step 12 to guide eggs supplied to the surface of the wire-netting 13 so that they are not moved externally of the disc 6 at the position other than predetermined position.

Figure 3:
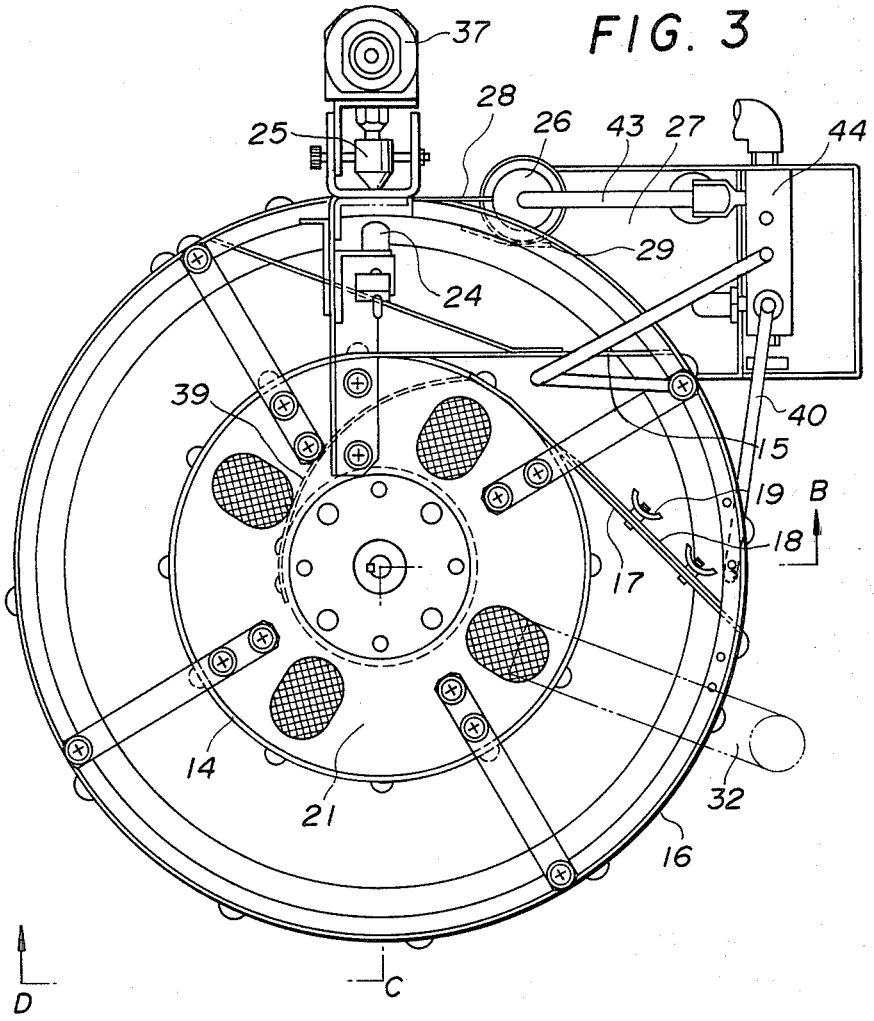
FIG. 3 is an enlarged top view of a rotary disc portion.

The inner guide plate 14 extending along the step 12 of the rotary disc 6 has one end extended in a tangential direction at open portions in inner and outer portions of the rotary disc 6 to form an inside straight-line guide plate 15 as shown in FIG. 3. This straight-line guide plate 15 has its extreme end connected to one end of an outside guide plate 16 provided at the position in the outer peripheral edge of the disc 6. The other end of the outside guide plate 16 comprises a fish-egg sorting station. At the other end of the inside guide plate 14 is tangentially extended the other straight-line guide plate 17, the extreme end of which is spaced apart from the outside guide plate 16 through substantially the diameter of an egg. This spacing may be adjusted by means of a gate plate 18 which can be adjusted by a thumbscrew 19 or the like according to the size of the fish egg. These guide plates are secured to a bearing cover 21 bolted to the base plate 5 together with the cap 10 through a bearing case 20, the lower ends thereof being suspended and held slightly spaced apart from the upper surface of the disc 6. The bearing cover 21 supports an outside guide ring 23 by a suitable number of support arms 22, and the outside guide plate 16 is hung from the ring 23 slightly spaced apart from the rotary disc 6.

The outside guide plate 16 is formed into an outside straight-line guide plate 28 extending in a tangential direction in the fish-egg sorting station to enable movement of the row of fish eggs rotated by the disc 6 outside the latter. The fish-egg sorting station comprises a photocell sensor 24, a high speed responsive type solenoid valve 37 and an air nozzle 25 next thereto. The photocell sensor 24 comprises, as is known, a projector which projects light to detect a whitening degree of fish eggs and a receiver for detecting a strength of reflected light from the eggs, which projector and receiver are commercially available. Compressed air from a air compressor not shown is supplied to the solenoid type air valve 37, and air is injected from the air nozzle 25 by a whitened egg detection signal of the photocell sensor 24 to slightly move the whitened egg toward the center of the rotary disc 6. Reference numeral 26 designates a hopper for good eggs, and 27 a hopper for bad eggs.

Fish eggs are stored within the water tank 2 in the condition that they are sinking in water. Air is blown from the air compressor 3 into a fish-egg lifting pipe 32 from an air chamber 31 via a pipe 30. The thus blown air moves up with water and the water containing the fish eggs is discharged by so-called air bubble pump action toward the disc 6 from the fish-egg lifting pipe 32.

Reference numeral 33 designates an overflow pipe, which also serves as a fish-egg delivery pipe. If fresh water is fed from a feed water port 34 into the water tank 2 to keep water in the water tank fresh as a consequence of which a water level increases, water in the level exceeding the overflow pipe 33 flows into the pipe 33 and is discharged outside the body 1. Reference numeral 35 designates a transparent plastic cover adapted to cover a chain driving station driven by the motor 7, and 36 designates a drain plug for draining the water tank 2.

Reference numeral 38 designates an discharge pipe for discharging good eggs, and 41 designates a feed water manifold for distributing water fed from the feed water port 34, which manifold distributes water to a feed water pipe 40 adapted to assist fish eggs on the rotary disc 6 in their sliding, a feed water port 42 adapted to feed fresh water into the water tank 2, and a feed water pipe 43 adapted to protect and flow down fish eggs within the good-egg discharge pipe 38. Reference numeral 44 designates a nozzle adapted to blow compressed air from the air compressor 3 at a right angle to a detection optical axis directly before the photocell sensor 24 to prevent adhesion of water drops on the lens of the photocell sensor.

Reference numeral 45 designates an air port adapted to delivery compressed air ($P=2.0^{kg}/cm^2$) to the solenoid type air valve 37, 46 a control panel and 47 a cover for the body 1.

Figure 6:
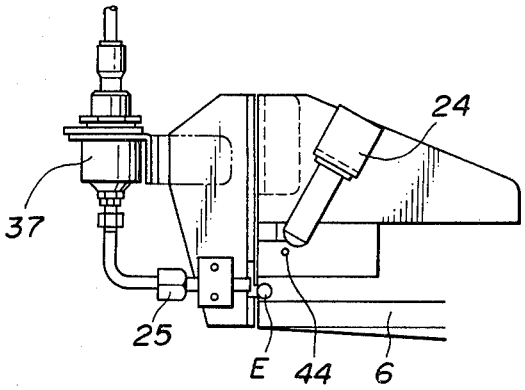
FIG. 6 is a fragmentary side view of a fish-egg sorting station.
Figure 7:
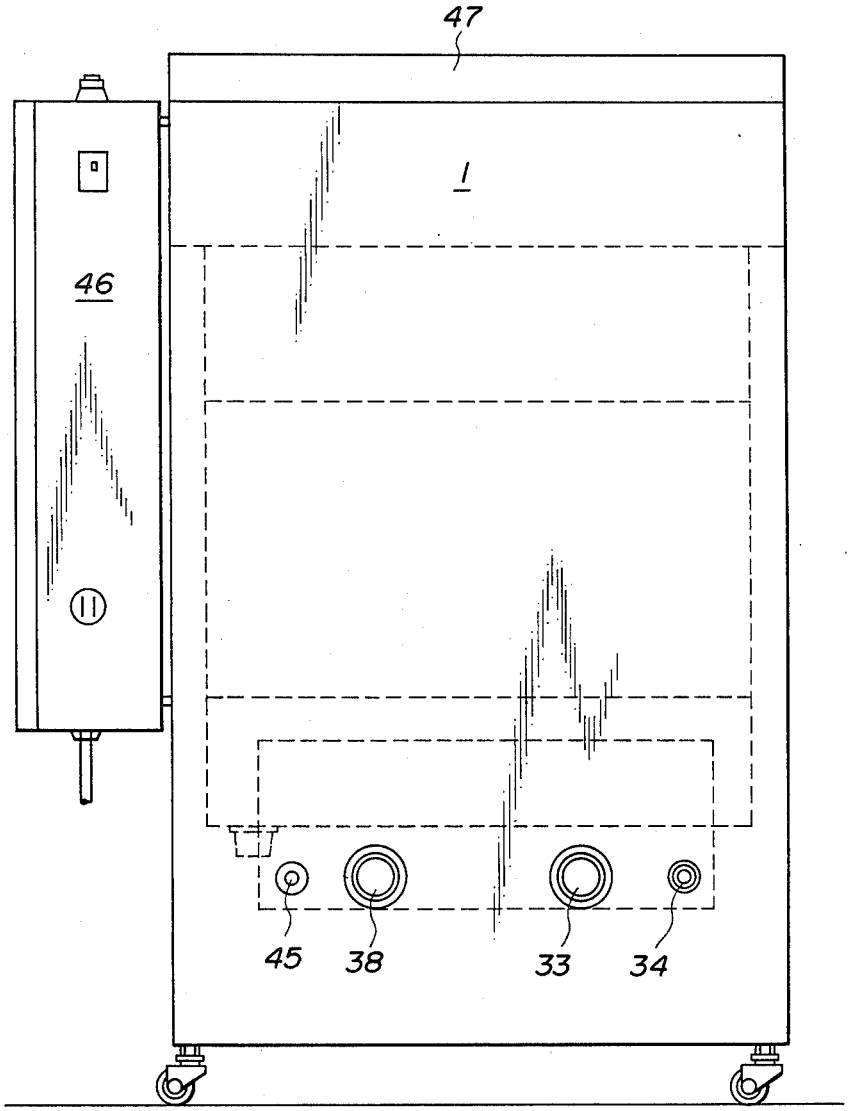
FIG. 7 is a side view of the apparatus body.

Reference character E in FIG. 6 designates fish eggs.

Next, how fish eggs are sorted by the present apparatus will be described hereinafter.

Fish eggs to be sorted are stored within the water tank 2 under the condition that they are floating in water but they gradually sink and are gathered in the bottom of the water tank 2. When pressure air from the air compressor 3 is fed into the fish-egg lifting pipe 32 through the pipe 30 and air chamber 31 to form bubbles, the bubbles move up within the fish-egg lifting pipe 32, at which time, water in the water tank moves up with the fish eggs stayed on the bottom. The fish eggs pumped up are discharged together with water onto the wire-netting 13 of the disc 6 rotated by the motor 37. Water discharged together with the fish eggs passes through the wire-netting, flows into the water groove 11, circulates from the hole 11' to the water tank 2 and only the fish eggs remain on the wire-netting 3. These fish eggs rotate along with the disc 6, gradually slide and move radially externally along the inner auxiliary guide plate 39 while subjecting to the action of centrifugal force, and are forced to slide out of the inside guide plate 14 to form a row of eggs.

This egg row passes between two straight-line guide plates 15 and 17 and is delivered outside the disc 6.

The fish eggs delivered to the outer part of the disc 6 reach the inside of the outside guide plate 16 while subjecting to a gradually increasing centrigual force.

In case the weight of fish eggs is too small and the centrifugal force is also too small, those eggs appeared to the outer part of the rotary disc 6 would not immediately arrive at the outside guide plate 16. However, even in such a case, the fish eggs impinge upon the straight-line guide plate 17 and are forcibly guided to the outside guide plate 16.

The guide plate 18 is adjusted to have a spacing between it and the outside guide plate 16 through which spacing only one row of fish eggs may pass, whereas those surplus eggs as not have been aligned fall through a cut window 16' provided below the outside guide plate 16 between two straight line guide plates 15 and 17 and then return into the water tank 2. Preferably, water may be supplied through the pipe 40 to a suitable position on the rotary disc 6 so as to enhance sliding of eggs on the rotary disc 6 and to prevent damages of eggs.

When the fish eggs thus aligned in one row are carried to and directly below the photocell sensor 24, it assumes that since dead and bad eggs become whitened, reflected light from the bad eggs is intense as compared with that from good eggs. This reflected light is detected by the receiver to feed drive pulses to the solenoid type air valve 37 by means of a known driving circuit. This drive pulse causes the air valve 37 to momentarily inject high speed air from the nozzle 25 so that the bad eggs being passed are slightly moved toward the center of the disc 6. The thus moved bad eggs are thereafter moved in a tangential direction by their own motion, pass along the inside of the outside partitioning plate 29 and fall into the bad-egg hopper 27 from the edge of the disc 6.

In the present invention, since the aforementioned air nozzle 25 is located directly below and close to the photocell detector station, water drops tend to adhere to the lens of the detector station by injection of air. Therefore, in the detector station, a flow of air from the air compressor 3 is directed toward the front surface of the lens to form an air curtain thereby preventing adhesion of water drops. If the bad-egg detector station and the discharge station thereof are provided in the same portion, complicated control of signal detection and timing of sorting driving, etc. becomes unnecessay but a quick response sorting station becomes necessary.

Those fish eggs not subjected to air shot as described above pass between the outside straight-line guide plate 28 and the outside partitioning plate 29, fall into the good-egg hopper 26 and are delivered outside the body through the pipe 38 whereas the bag eggs are delivered through the pipe 33. If these hoppers are always fed with water, the fish eggs are smoothly delivered outside the body.

Figure 1:
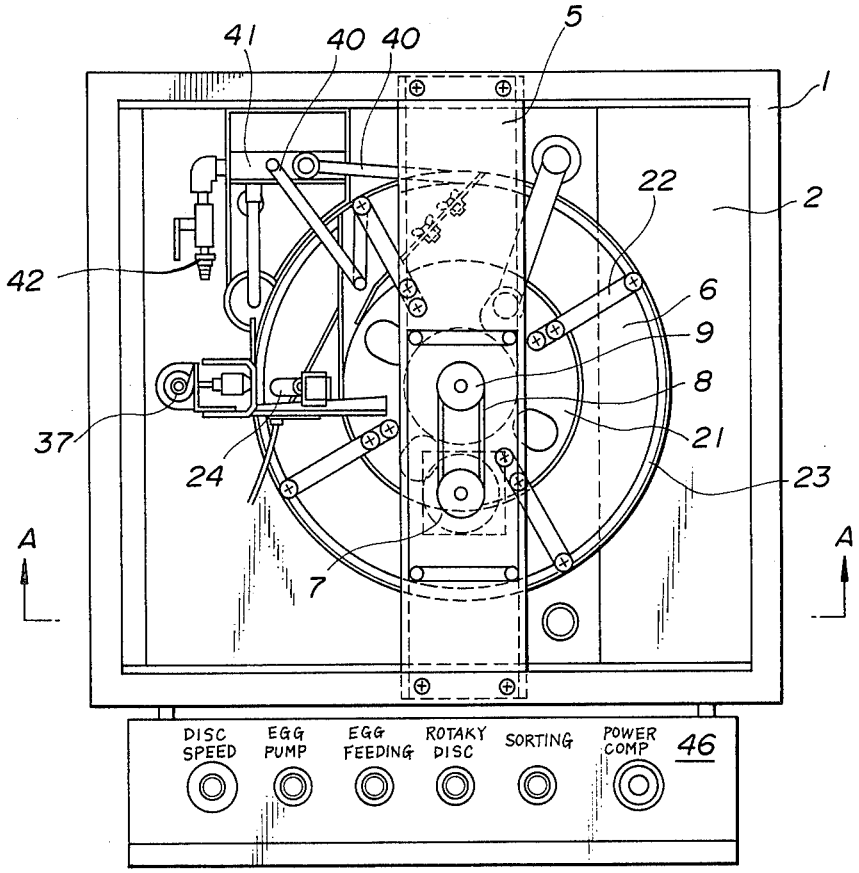
FIG. 1 is a top view of a fish-egg sorting apparatus in accordance with the present invention.
Figure 2:
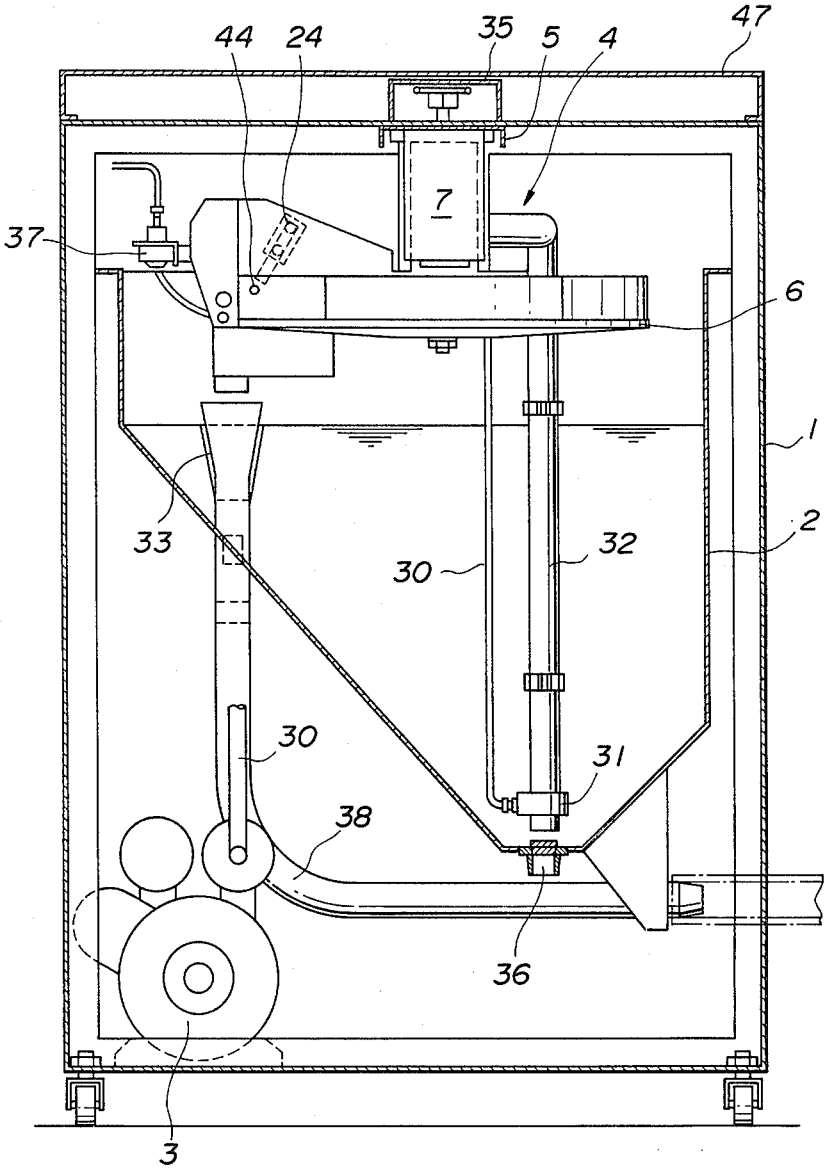
FIG. 2 is a sectional view taken on line A—A of FIG. 1.

As one example in embodying the present invention, the fish-egg sorting machine shown in FIGS. 1 and 2 may be modified to have two to three times of sorting capacity thereof by the provision of an arrangement wherein two or three guide plates, air nozzles, photocell means, etc. are symmetrically mounted on the disc 6. Further, since these sorting apparatuses are incorporated as a unit into the upper base plate 5, said unit may be exchanged as necessary to thereby change the sorting capacity.

In addition, since all of sorting operations are effected with the body 1 and the disc 6 is rotated within the water tank 2, there poses no problem in that water is scattered outside the body, thus keeping environment extremely clean. With respect to materials which constitute the body, high class materials need not be used in consideration of rust or the like, thus restricting high cost.

Moreover, while the interior of the inside guide plate 14 functions as a device for supply of fish-egg rows, it is possible to replace this portion with other well-known feeders such as vibrators as needed.

What is claimed is:

1. A fish-egg sorting apparatus comprising a frame, a rotary disc mounted on said frame, a feeder for feeding fish eggs to a position close to the center of said rotary disc, whereby upon rotation of said disc the fish eggs are moved by centrifugal force radially outwardly toward the periphery of said disc, a guide plate mounted on the frame and disposed along the outer periphery of said rotary disc for aligning said radially moved fish eggs in a row, means for detecting bad eggs in said row of eggs including an optical sensor, means for separating the bad eggs from the row of eggs in response to detection by said sensor, means for collecting the remaining good eggs, and driving means for rotating said rotary disc.

2. The fish-egg sorting apparatus as claimed in claim 1, wherein feed water nozzles are suitably disposed on the disc to prevent the fish eggs from being damaged due to their sliding along the rotary disc and guide plate.

3. The apparatus of claim 1 wherein set feeder comprises an air bubble pump.

4. The fish-egg sorting apparatus as claimed in claim 1, wherein said means for separating station is provided so that either good eggs or bad eggs are moved radially of the rotary disc to thereby effect sorting as a difference in position on the rotary disc.

5. The fish-egg sorting apparatus as claimed in claim 4, wherein said movement of the fish eggs in a radial direction is effected by high speed injection of air.

6. The fish-egg sorting apparatus as claimed in claim 5, wherein said means for detecting includes a photocell sensor for detection of bad eggs, said photocell sensor being arranged adjacent said guide plate in the proximity of an air nozzle for said high speed injection of air having a high speed responsiveness, and an air curtain is arranged in front of the photocell sensor to prevent splashes caused by said injection.

7. The fish-egg sorting apparatus as claimed in claim 1, wherein said guide plate comprises an inside guide plate and an outside guide plate, said inside guide plate being provided with an opening to allow movement of fish eggs supplied internally thereof toward the outside and straight line guide plates substantially reaching the outside guide plate on both sides thereof.

8. The fish-egg sorting apparatus as claimed in claim 7, wherein one of said straight line guide plates is provided with a gate plate capable of adjusting a spacing between said straight line guide plate and said outside guide plate.

* * * * *